US008686817B2

(12) United States Patent
Kubono et al.

(10) Patent No.: US 8,686,817 B2
(45) Date of Patent: Apr. 1, 2014

(54) ELECTROMAGNETIC RELAY

(75) Inventors: Kazuo Kubono, Shinagawa (JP); Takashi Yuba, Shinagawa (JP); Satoshi Takano, Shinagawa (JP); Daiei Iwamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/597,469

(22) Filed: Aug. 29, 2012

(65) Prior Publication Data

US 2013/0057370 A1 Mar. 7, 2013

(30) Foreign Application Priority Data

Sep. 1, 2011 (JP) ..... 2011-190630

(51) Int. Cl.
*H01H 51/22* (2006.01)

(52) U.S. Cl.
USPC ..... 335/78

(58) Field of Classification Search
USPC ..... 335/78
See application file for complete search history.

(56) References Cited

U.S. PATENT DOCUMENTS

| | | | | |
|---|---|---|---|---|
| 5,986,529 | A * | 11/1999 | Miyata et al. | 335/78 |
| 6,489,868 | B1 * | 12/2002 | Sato et al. | 335/78 |
| 6,771,154 | B1 * | 8/2004 | Funayama et al. | 335/159 |
| 6,873,232 | B2 * | 3/2005 | Chida et al. | 335/78 |
| 7,859,371 | B2 * | 12/2010 | Takano | 335/78 |
| 8,207,803 | B2 * | 6/2012 | Iwamoto et al. | 335/78 |
| 2005/0046527 | A1 * | 3/2005 | Chida et al. | 335/78 |
| 2010/0066468 | A1 * | 3/2010 | Iwamoto et al. | 335/128 |

FOREIGN PATENT DOCUMENTS

| | | |
|---|---|---|
| JP | 2000-195405 | 7/2000 |
| JP | 2009-105072 | 5/2009 |

* cited by examiner

*Primary Examiner* — Alexander Talpalatski
(74) *Attorney, Agent, or Firm* — Staas & Halsey LLP

(57) ABSTRACT

An electromagnetic relay includes an electromagnet part, an actuating part, a contact part and a base for holding the electromagnet part, the actuating part and the contact part. The contact part includes a pair of fixed plates having one end fixed to the base and the other end to which a fixed contact is attached, a pair of movable springs having one end fixed to the base and the other end to which a movable contact is attached, and a connecting portion extending between the movable springs and electrically connecting the movable contacts to each other. The actuating part is actuated so as to press only a part of the movable springs inside an area defined between longitudinal axes extending between one end and the other end of the movable springs through the movable contact, when the contact part closes.

3 Claims, 8 Drawing Sheets

ELECTROMAGNETIC RELAY

CROSS-REFERENCE TO RELATED APPLICATIONS

This application is based upon and claims the benefit of priority of the prior Japanese Application No. 2011-190630, filed Sep. 1, 2011, the entire contents of which are incorporated herein by reference.

BACKGROUND OF THE INVENTION

1. Field of the Invention

This invention relates to an electromagnetic relay.

2. Description of the Related Art

An electromagnetic relay has been known, which opens and closes a contact part by an action of magnetic force generated by an excited coil wound around an iron core (See JP 2008-243427A.). An electromagnetic relay has also been known, which includes a contact part including a pair of movable contacts and a pair of fixed contacts (See JP 2010-73323A, JP 2010-123545A and JP 5-2963A.).

There is a need for an electromagnetic relay with a pair of movable contacts and a pair of fixed contacts capable of stably and reliably opening and closing the contacts.

SUMMARY OF THE INVENTION

According to one embodiment of the present invention, an electromagnetic relay is provided, the electromagnetic relay comprising an electromagnet part, an actuating part which is actuated in response to a magnetic action of the electromagnet part, a contact part which opens and closes in response to actuation of the actuating part, and a base for holding the electromagnet part, the actuating part and the contact part, wherein the contact part includes a pair of fixed plates extending in parallel to each other and having a first end fixed to the base and a second end opposite to the first end, a pair of fixed contacts attached to the second end of the fixed plates, a pair of movable springs extending in parallel to each other and having a first end fixed to the base and a second end opposite to the first end, a pair of movable contacts attached to the second ends of the movable springs, and a connecting portion extending between the pair of the movable springs and electrically connecting the pair of the movable contacts to each other, and wherein the actuating part is actuated so as to press a part of the movable springs inside an area defined between longitudinal axes extending between the first end and the second end of the pair of the movable springs through the movable contact, when the contact part closes.

DETAILED DESCRIPTION

Figure 1:
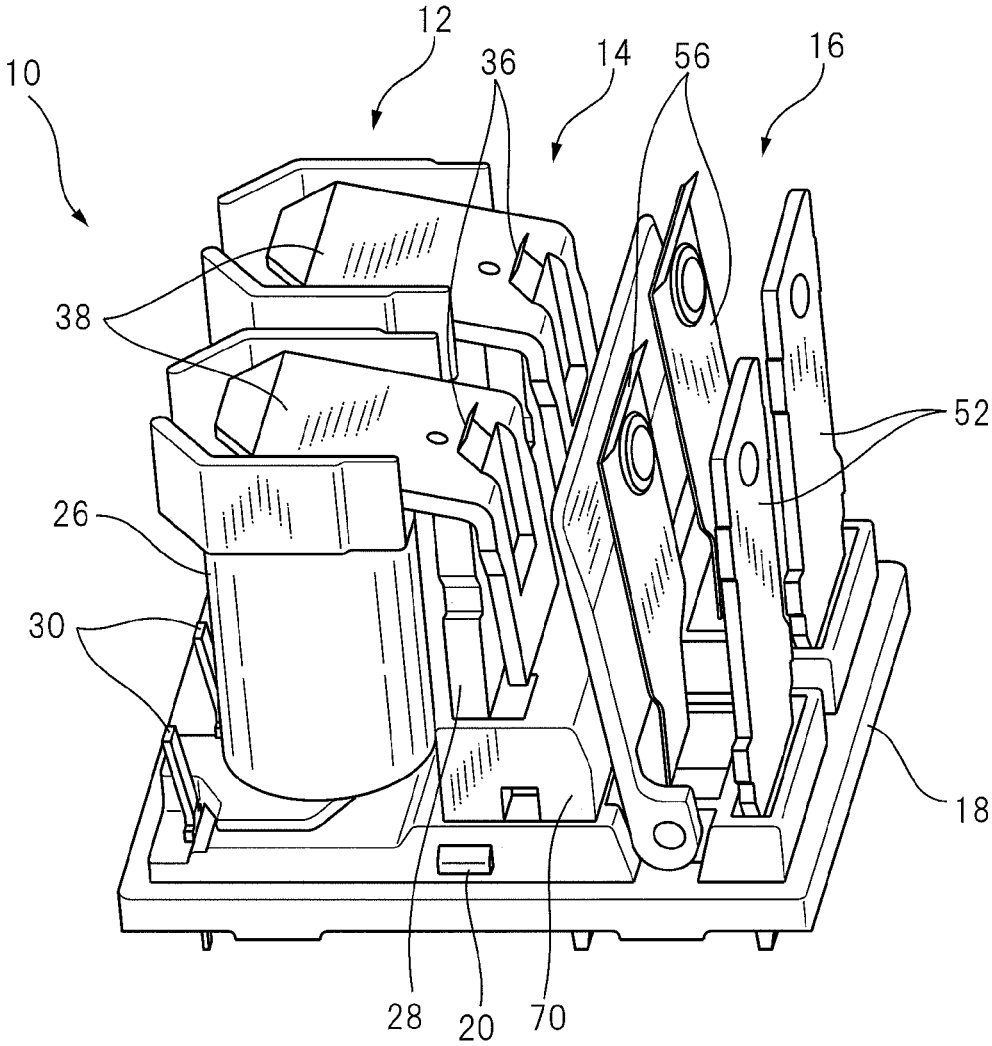
FIG. 1 is a perspective view illustrating an electromagnetic relay according to one embodiment of the present invention.

Embodiments of the present invention will be described below with reference to the accompanied drawings. Like elements commonly used in different drawings or different embodiments are designated with the same reference numerals. The scales of elements in relation to one another may be modified as necessary for the purpose of clarification of the drawings. Although relationships between positions of the elements or orientations of the elements may be specified in the following description, they are merely intended to explain particular embodiments in relation to the illustrated positions, unless otherwise mentioned, and not intended to limit practical applications or arrangements of the element in any manner.

Figure 2:
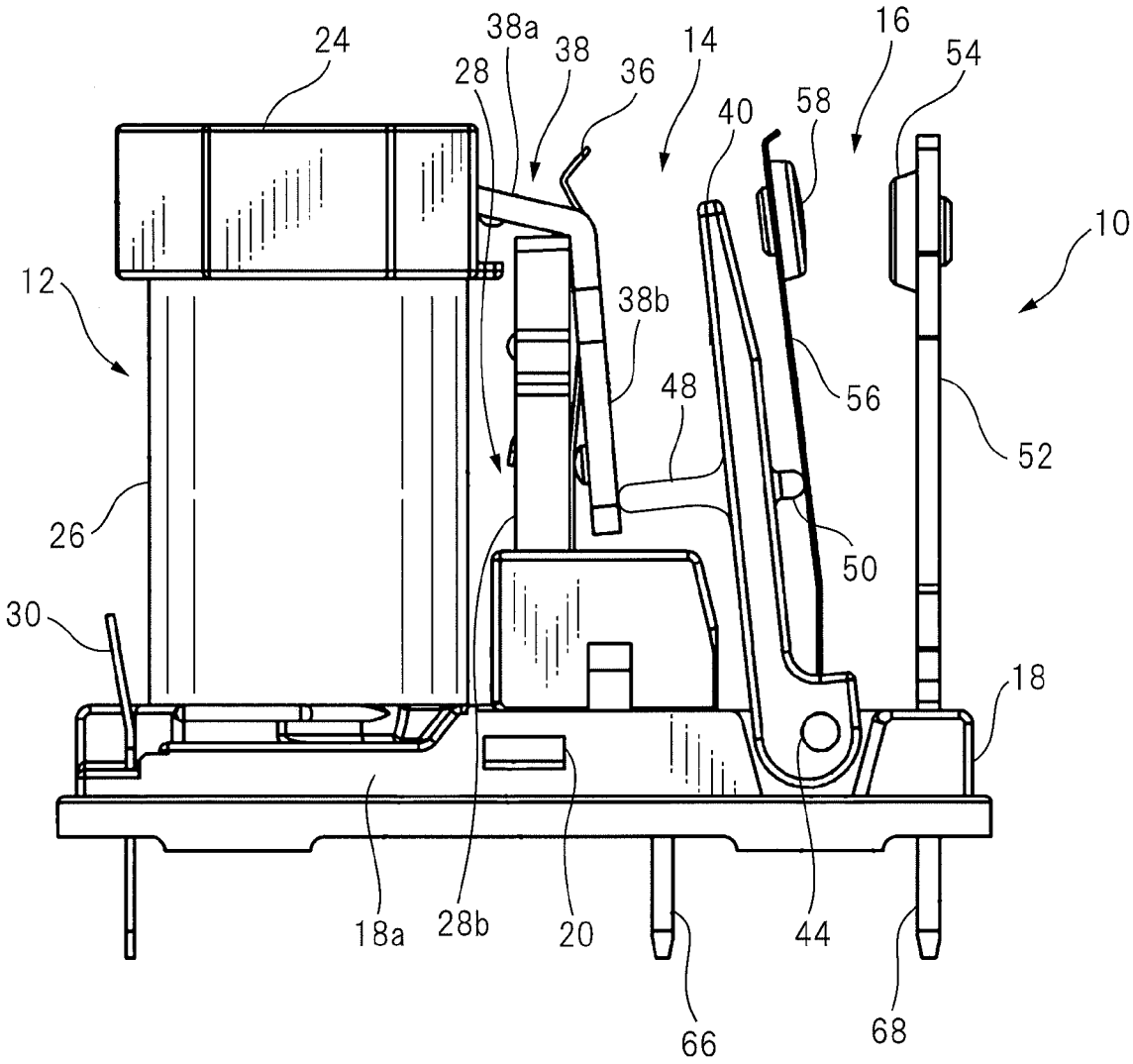
FIG. 2 is a side view illustrating the electromagnetic relay according to the embodiment.
Figure 3:
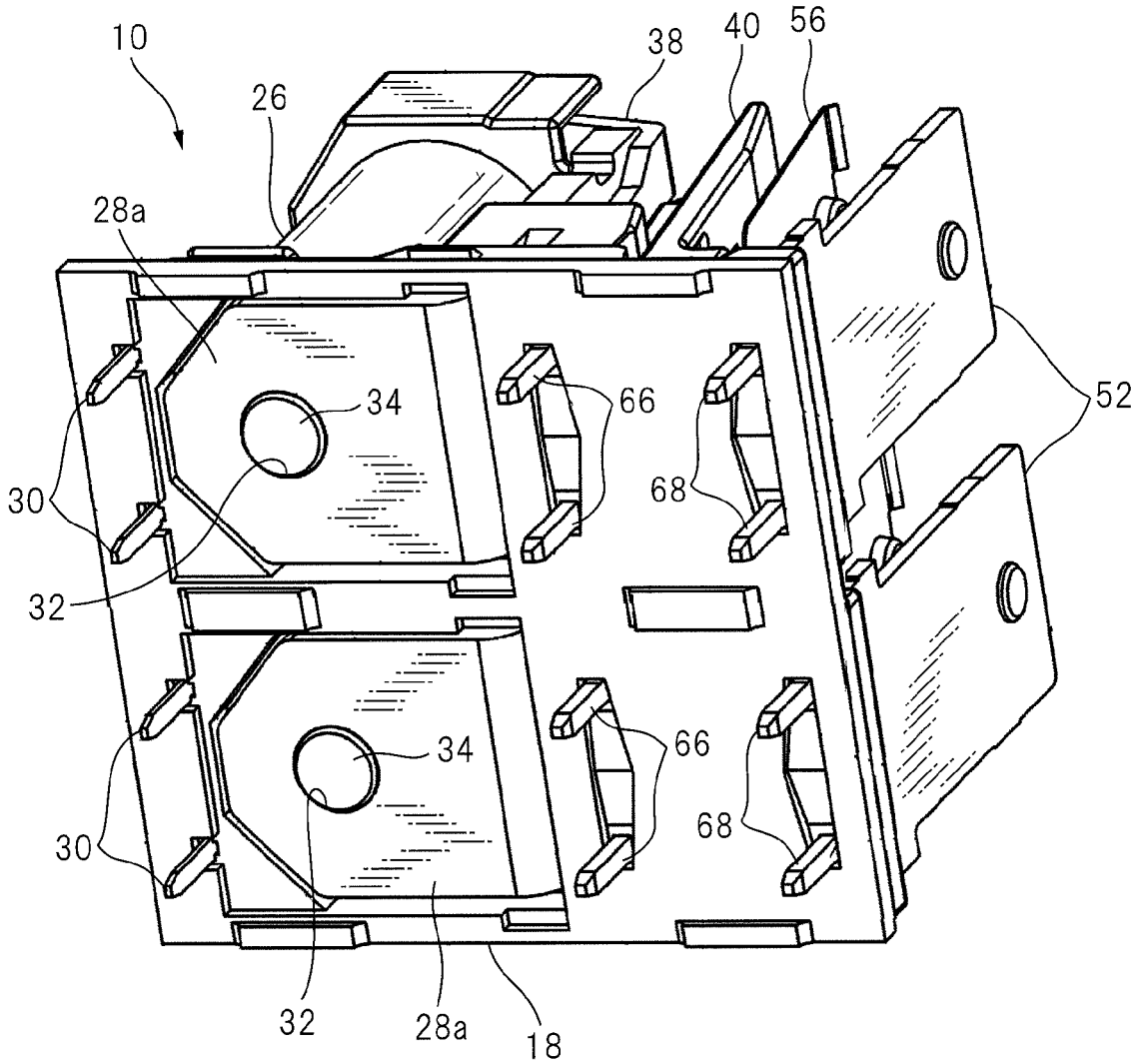
FIG. 3 is a perspective view illustrating the electromagnetic relay according to the embodiment, taken from the bottom.

FIG. 1 is a perspective view illustrating an electromagnetic relay 10 according to one embodiment of the present invention, FIG. 2 is a side view illustrating the electromagnetic relay 10 according to the embodiment, and FIG. 3 is a perspective view illustrating the electromagnetic relay 10 according to the embodiment, taken from the bottom. The electromagnetic relay 10 includes an electromagnet part 12, an actuating part 14 which is actuated in response to a magnetic action of the electromagnet part 12, and a contact part 16 which opens and closes in response to the actuation of the actuating part 14. The electromagnetic relay 10 also includes a base 18 made of resin, on which the electromagnet part 12, the actuating part 14 and the contact part 16 are held. The base 18 cooperates with a cover also made of resin, which is not illustrated, to form a housing of the electromagnetic relay 10. The cover has an upper wall forming an upper face of the housing and a peripheral wall extending downward in the vertical direction from the peripheral edge of the upper wall. The cover defines an opening at the bottom and has a shape surrounding each component held on the base 18 when attached to the base 18. In the illustrated embodiment, engageable portions 20 in the form of a protrusion formed on side faces of the base 18 are fitted to recesses or fitting holes formed at lower ends of the side walls of the cover, in order to assemble the base 18 and the cover.

Figure 4:
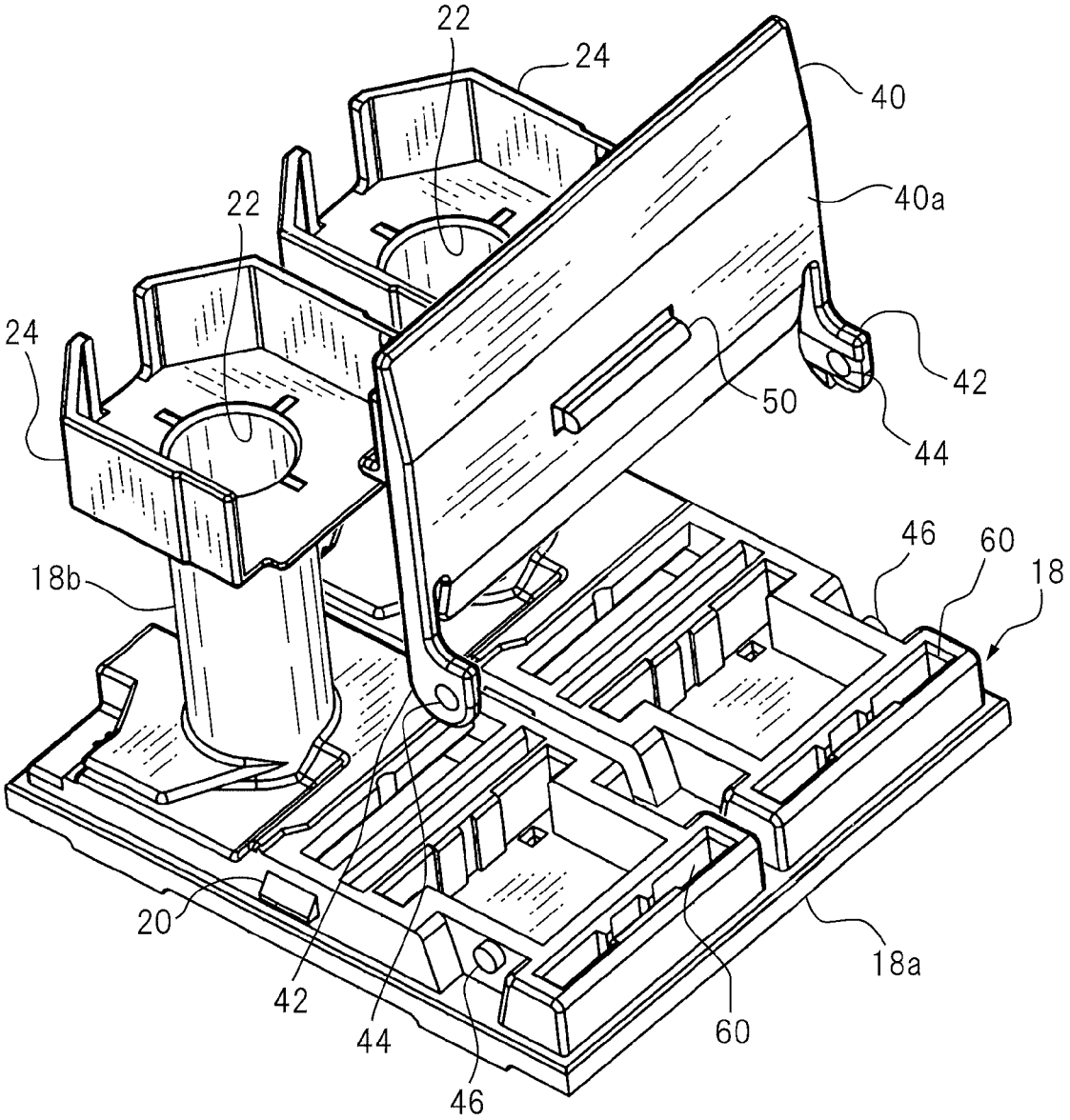
FIG. 4 is a perspective view illustrating a base and a card of the electromagnetic relay according to the embodiment.

FIG. 4 is a perspective view illustrating the base 18 and a card 40 of the electromagnetic relay 10 according to the embodiment. The base 18 includes a flat plate portion 18*a* substantially in the form of a flat plate and forming the bottom of the electromagnetic relay 10, and a pair of cylindrical portions 18*b* extending substantially cylindrically from the flat plate portion 18*a* in the vertical direction. The cylindrical portion 18*b* defines the interior capable of receiving an iron core (only its lower end portion 34 is shown in FIG. 3), which is inserted to an opening 22 formed at the upper end of the cylindrical portion 18*b*. A guide wall 24 is integrally formed with the cylindrical portion 18*b*, or separately attached to the cylindrical portion 18*b* at the upper end of the cylindrical portion 18*b*.

Returning to FIGS. 1 to 3, the electromagnet part 12 includes the iron core described above, which is not shown, an electromagnetic coil 26 formed around the iron core, and a yoke 28 engageable with the lower end portion 34 of the iron core so as to form a magnetic path. In the illustrated embodiment, the electromagnet part 12 includes a pair of units placed side by side on the base 18 and formed from the same parts. Each unit includes the electromagnetic coil 26. The electromagnetic coil 26 is formed by winding a conductive wire around the iron core, i.e., around the cylindrical portion 18*b*. Both ends of the conductive wire of the electromagnetic coil 26 are fixedly attached to coil terminals 30 extending through the base 18 substantially in the vertical direction. The coil terminals 30 serve as exciting terminals for supplying the electromagnet part 12 with electric power. Therefore, the electromagnet part 12 serves as an electromagnet for generating a magnetic field upon receiving electric power through the coil terminals 30. The yoke 28 is a magnetic element having a horizontal piece 28*a* and a vertical piece 28*b* integrally formed with each other. The yoke 28 is L-shaped in side view. When assembled, the horizontal piece 28*a* extends horizontally and defines an engaging hole 32, so as to receive the lower end portion 34 of the iron core (See FIG. 3.). The vertical piece 28*b* extends substantially vertically from one of the edges of the horizontal piece 28*a*.

The actuating part 14 is actuated in response to a magnetic action of the electromagnet part 12 and moves movable contacts 58 of the contact part 16. The actuating part 14 includes an armature 38 rotatably attached to the yoke 28 with a leaf spring 36 interposed therebetween, and the card 40 for pressing the movable springs 56, in response to actuation of the armature 38. As shown in FIG. 1, the armature 38 has a contact plate portion 38*a* and a pressing plate portion 38*b*, which are integrally formed with each other, so as to form an obtuse angle therebetween. In the illustrated embodiment, a pair of armatures 38 are provided, corresponding to the pair of electromagnetic coils 26, respectively, so as to cooperate therewith. At a portion where the contact plate portion 38*a* and the pressing plate portions 38*b* are combined with each other, the armature 38 is in contact with the yoke 28 along an edge of the upper end of the yoke 28, so as to be able to rotate about the edge as a fulcrum.

The card 40 has a pressing portion 50 protruding from a front face 40*a* so as to press the movable springs 56, and protruding pieces 48 protruding from a back face 40*b* toward the armatures 38. The card 40 also has fitting holes 44 at a pair of legs 42 which extend downward from both of the side edges of the card 40. On the other hand, the base 18 has fitting protrusions 46 extending toward the side edges of the base 18 and adapted to be fitted to the fitting holes 44 (See FIG. 4.). With these fitting protrusions 46 fitted to the fitting holes 44 of the card 40, the card 40 is pivotally attached to the base 18.

Figure 5:
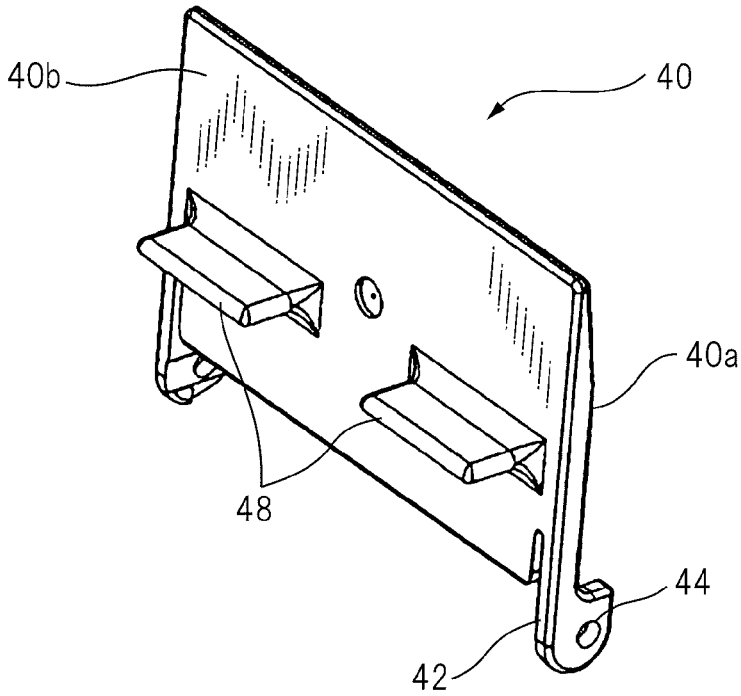
FIG. 5 is a perspective view illustrating the card of the electromagnetic relay according to the embodiment, taken from the back.

FIG. 5 is a perspective view illustrating the card 40, taken from the back face 40*b*. As illustrated, the card 40 has a pair of protruding pieces 48 on the back face 40*b* of the card 40 opposite to the armatures 38, and the protruding pieces 48 extends substantially in parallel to and spaced apart from each other. These protruding pieces 48 are adapted to be engaged with through holes or recesses formed in areas of the armatures 38 opposite to the protruding pieces 48. The card 40 also has a pressing portion 50 for pressing the movable springs 56 on the front face 40*a* of the card 40 opposite to the back face 40*b* having the protruding pieces 48. A manner in which the movable springs 56 are pressed by means of the pressing portion 50 will be described below in more details.

As stated above, the actuating part 14 is configured such that the card 40 pivots in relation to the base 18, as the armatures 38 is actuated, thereby pressing the movable springs 56 by means of the pressing portion 50 of the card 40.

The contact part 16 includes a pair of fixed plates 52 extending in parallel to each other and fixed to the base 18, a pair of fixed contacts 54 provided at tip ends of the fixed plates 52, a pair of movable springs 56 extending in parallel to each other and having one ends fixed to the base 18 and the other ends which are free ends, a pair of movable contacts 58 provided at the other ends of the movable springs 56, and a connecting portion extending between the pair of the movable springs 56 and electrically connecting the pair of the movable contacts 58 to each other. The fixed plates 52 are fixed to the base 18 at their base ends, which are inserted to attaching holes 60 of the base 18, so as to stand substantially vertically in relation to the base 18. The fixed plates 52 have the fixed contacts 54 in the form of a rivet at the tip ends thereof, and the fixed contacts 54 protrude from the surface of the fixed plates 52 and opposite to the movable contacts 58. The movable springs 56 are attached to the base 18 so as to be opposite to the fixed plates 52 with a certain gap therebetween. The movable springs 56 have the movable contacts 58 in the form of a rivet at the tip ends thereof so as to protrude from the surface of the movable springs 56 in a similar manner to the fixed contacts 54. In the illustrated embodiment, the connecting portion for electrically connecting the pair of movable contacts 58 is a conductive piece 62 separately formed from the movable springs 56 and attached to the pair of the movable springs 56. The conductive piece 62 is fixedly attached to the movable springs 56 via the movable contacts 58, which are electrically connected to each other through the conductive piece 62. With the conductive piece 62 formed separately from the movable springs 62 as described above, the size of the conductive piece 62 may be modified, depending on a target load current passing through the contact part 16, for example, and therefore, greater freedom for design will be ensured. In an alternative embodiment which is not shown, a pair of movable springs and a connecting portion for electrically connecting a couple of movable contacts may be integrally formed with each other. In this case, a process for attaching a separate member such as the conductive piece 62 is not required, and the number of parts is reduced, thereby lowering the cost.

Figure 7:
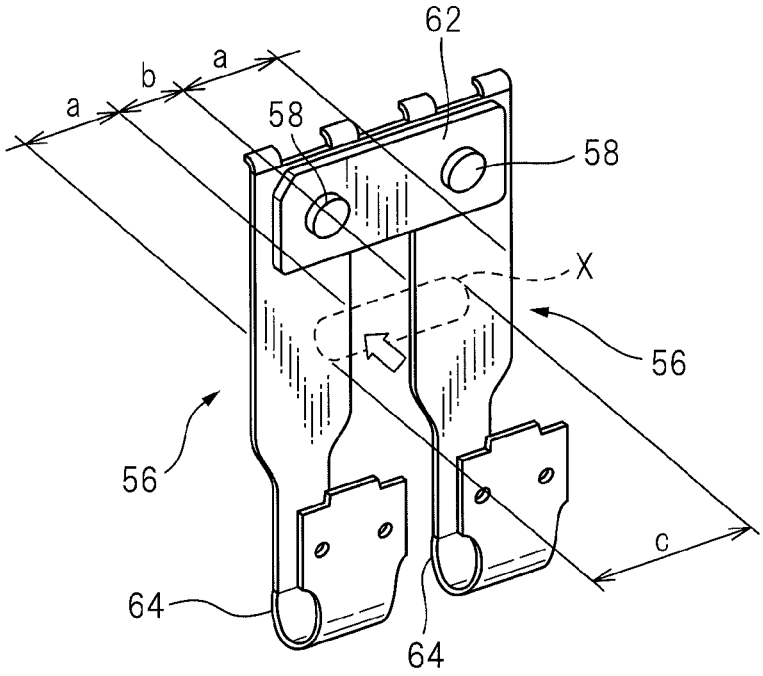
FIG. 7 is a perspective view in order to explain the pressed portion of movable springs of the electromagnetic relay according to the embodiment.

In the illustrated embodiment, each movable spring 56 has at the base end a curved portion 64 curved away from the fixed plate 52 in a U-shaped manner (See FIG. 7.). The movable spring 56 with the curved portion 64 has advantages in that less amount of force is required for deforming the movable spring 56 to move toward the fixed plate 52, compared with a plate member of a straight shape. Further, in the case as illustrated where first terminals 66 are provided so as to extend downward from the base ends of the movable springs 56 and through the base 18, the distances between the first terminals 66 and second terminals 68 extending from the fixed plates 52 are sufficiently maintained. This ensures that short-circuiting by unintentionally contacting the first terminals 66 and the second terminals 68 is prevented, thereby improving efficiency in a process of mounting the electromagnetic relay 10 to a substrate (not shown), for example. The base ends of the movable springs 56 cannot be seen in FIG. 1, since they are accommodated in a protective cover 70 for electrically insulating the base ends as well as protecting them from mechanical damages or from deposition of contaminating substances thereto.

Next, opening and closing operations in the electromagnetic relay 10 according to the embodiment will be described. In a state where no electric power is externally supplied, the movable contacts 58 are distant from the fixed contacts 54 (See FIGS. 1 and 2.), and a pathway of electric current through the contact part 16 is blocked. In the electromagnetic relay 10 in this state, electric power is supplied to the electromagnetic coils 26 of the electromagnet part 12 through the coil terminals 30, and as a result, the contact part 16 becomes electrically conductive. When supplying the electric power to the electromagnetic coils 26 is stopped, the contact part 16 opens again, and the pathway of the electric current is then blocked.

Supplying electricity to the electromagnetic coils 26 is carried out through the coil terminals 30, and a magnetic field is generated around the electromagnetic coils 26 and the iron cores. As shown in FIG. 3, the coil terminals 30 extend out of the lower surface of the base 18, so that the external power supply can be electrically connected to the coil terminals 30 by plugging the coil terminals 30 to suitable receiving portions of a substrate for mounting the electromagnetic relay 10 thereon (not shown). By generating a magnetic field in this way, attractive force exerts on the armatures 38. As a result, the armatures 38 rotate counterclockwise around the upper ends of the yokes 28 as fulcrums, and the contact plate portions 38*a* of the armatures 38 are brought into contact with the upper ends of the iron cores. The protruding pieces 48 of the card 40 in contact with the pressing plate portions 38*b* of the armatures 38 are pressed as the armatures 38 rotate. The card 40 has, on the front face 40*a* opposite to the movable springs 56, the pressing portion 50 for pressing the movable springs 56 as described above. Therefore, when the card 40 is pressed by the armatures 38 so as to pivot, the movable springs 56 are deformed to move toward the fixed plates 52 until the movable contacts 58 come in contact with the fixed contacts 54.

Figure 6:
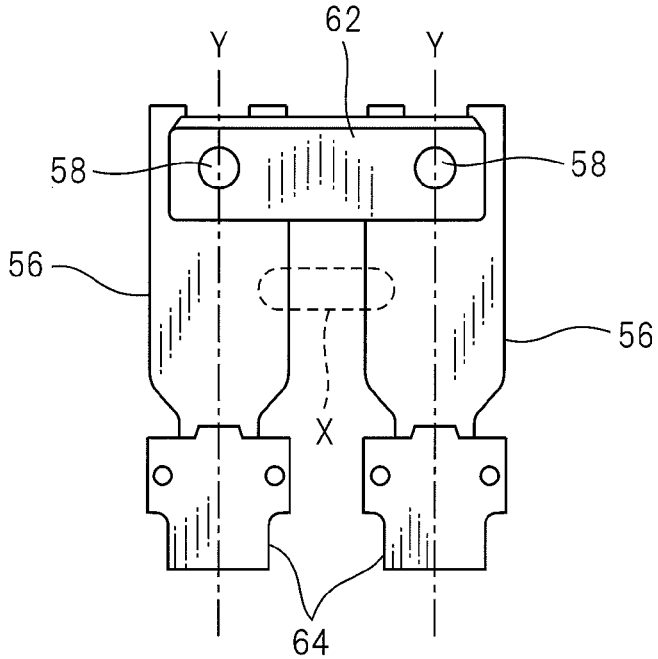
FIG. 6 is a front view in order to explain a pressed portion of movable springs of the electromagnetic relay according to the embodiment.

In the embodiment, pressing force applied by the card 40 exerts substantially only on a pressed portion X, which is shown by dashed line in FIGS. 6 and 7. Thus, the actuating part 14 presses only a part of the pair of the movable springs 56 inside an area defined between longitudinal axes Y and Y extending through the pair of the movable contacts 58 (In FIGS. 6 and 7, only one side on which the movable contacts 56 are provided can be seen.). In this way, the movable contacts 58 and the fixed contacts 54 are brought into contact with each other. Therefore, opening and closing operations of the contact part 16 can be smoothly carried out.

Figure 10:
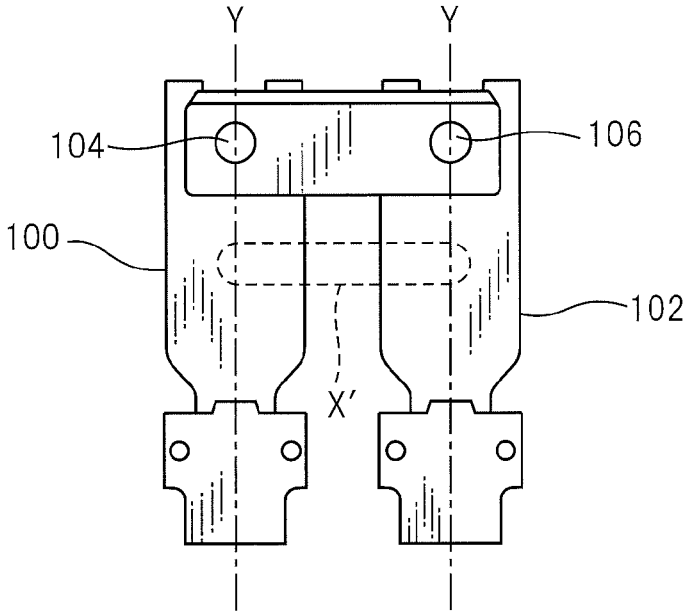
FIG. 10 is a comparative view in order to explain a pressed portion of movable springs of an electromagnetic relay according to a prior art.

Referring to FIGS. 6, 7 and 10, an operation and effect of the embodiment will be described. FIG. 6 is a front view in order to explain the pressed portion X of the movable springs 56 of the electromagnetic relay 10 according to the embodiment. FIG. 7 is a perspective view in order to explain the pressed portion X of the movable springs 56 of the electromagnetic relay 10 according to the embodiment. FIG. 10 is a comparative view in order to explain a pressed portion X' of movable springs 100 and 102 of an electromagnetic relay according to a prior art. First, the movable springs 100 and 102 of the comparative example will be described. As shown in FIG. 10, the movable springs 100 and 102 are designed to receive pressing force over a part of the movable springs 100 and 102 (i.e., the pressed portion X') which extends beyond each axis Y extending through movable contacts 104 and 106. The pair of the movable contacts 104 and 106 may come in contact with corresponding fixed contacts such that slightly after one of the movable contacts 104 comes in contact with the corresponding fixed contact, the other of the movable contact 106 comes in contact with the corresponding fixed contact, rather than the case where the pair of the movable contacts 104 and 106 substantially simultaneously come in contact with the corresponding fixed contacts, respectively. In such a case, the movable contact 104 which is first brought into contact with the fixed contact remains subject to the pressing force applied by a card over the pressed portion X' even after brought into contact with the fixed contact. Consequently, the movable spring 100 according to the comparative example is under influence of moment of force for rotating the movable springs 100 and 102 around the movable contact 104 which has been first brought into contact with the fixed contact and then acts as a fulcrum. On the other hand, the other movable spring 102 is subject to force for moving the movable contact 106 away from the corresponding fixed contact. This is especially remarkable when it comes to pressing force exerting on a part of the pressed portion X' extending outside of the axis Y of the movable spring 100. As a result, greater force will be required in order to bring the other movable contact 106 into contact with the fixed contact, or a process for rendering the contact part conductive will be delayed, and thus, an operation of the electromagnetic relay will be unstable.

However, according to the embodiment as shown in FIGS. 6 and 7, the pressed portion X of the movable springs 56 only extends inside the area defined between the longitudinal axes Y and Y extending through the movable contacts 58. Therefore, even in the case where one of the movable contacts 58 first comes in contact with the corresponding fixed contact 54, no moment of force will exert on the movable spring 56 around the movable contact 58 as a fulcrum. Consequently, opening and closing operations of the contact part 16 can be stably and reliably carried out.

For example, in the illustrated embodiment, with a width "a" of the movable spring 56, a gap "b" between the pair of movable springs 56 and a width "c" of the pressed portion X (FIG. 7), they are designed so as to satisfy the ratio a:b:c=5:3:4. Therefore, in this example, pressing force exerts only on a range extending from the inner edge of the movable spring 56 to a tenth of the width a of the movable spring 56. The above ratio merely represents one example and, of course, may be modified as necessary. Thus, the ratio may also be in a range such that no or only a negligible amount of moment of force around the axis Y as a fulcrum acts on the movable springs 56.

An operation of rendering the contact part 16 conductive has been described above. In order to open the contact part 16 again, supplying electricity to the electromagnet part 12 is stopped. Once supplying electricity to the electromagnet part 12 is stopped, the attractive force that has exerted between the electromagnet part 12 and the actuating part 14 will be removed. On the other hand, the restorative force of the leaf spring 36 interposed between the yoke 28 and the armature 38 urges the card 40 in a direction so as to open the contact part 16. Therefore, after supplying electricity to the electromagnet part 12 is stopped, the card 40 quickly returns to a position where it was before electricity is supplied, so that the movable contacts 58 move away from the fixed contacts 54, and the contact part 16 opens.

Figure 8:
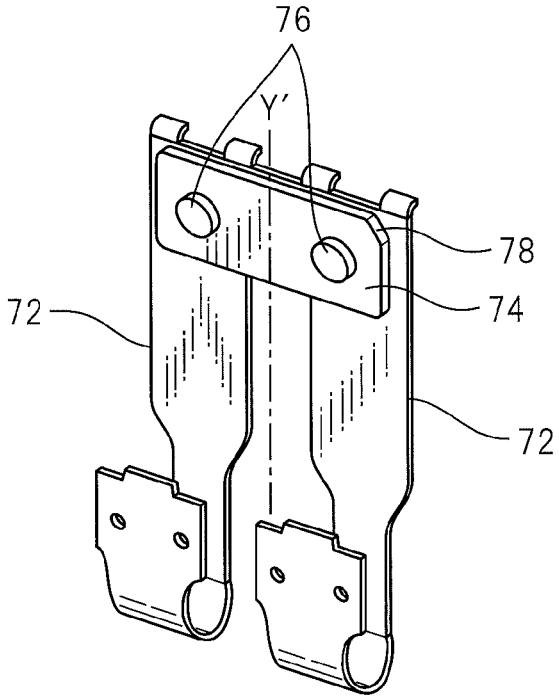
FIG. 8 is a perspective view illustrating movable springs according to a variant of the embodiment.

FIG. 8 is a perspective view illustrating movable springs 72 according to a variant of the movable spring described above. The movable springs 72 are similarly configured to the movable springs 56 described above, except for a conductive piece 74 having a different shape. The conductive piece 74 in the variant has an asymmetrical shape in relation to a central axis Y' extending in parallel to an axis extending through the movable contact 76. In the illustrated embodiment, the conductive piece 74 has a cutout portion 78 on one of its edges. With the aid of the movable springs 72 having an asymmetrical shape, it becomes clear as to how the conductive piece 74 should be oriented when the conductive piece 74 is attached to the movable springs 72, thereby improving efficiency in the attaching operation.

Figure 9:
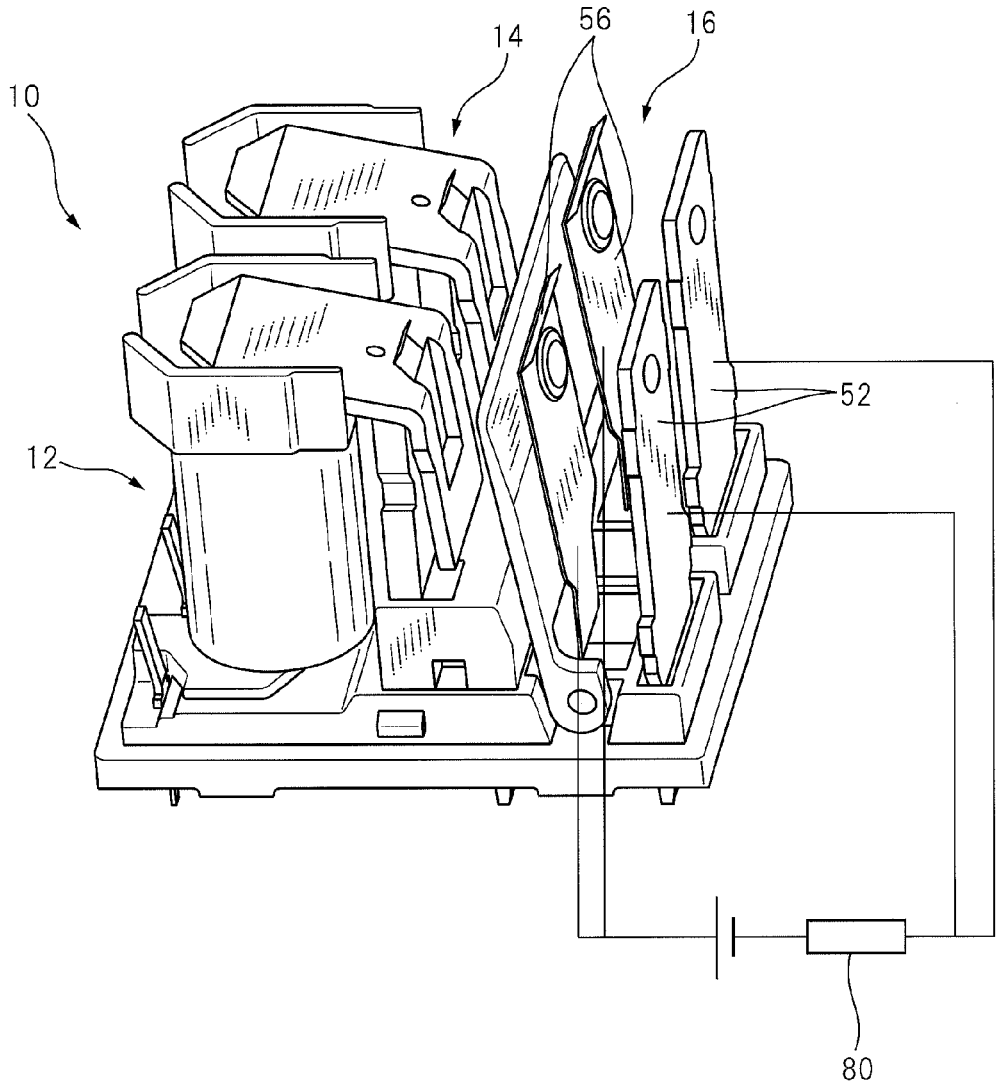
FIG. 9 is a perspective view in order to explain a circuit configuration with the electromagnetic relay according to the embodiment.

FIG. 9 is a perspective view in order to explain an example of the circuit configuration including the electromagnetic relay 10 according to the embodiment. As described in relation to FIG. 3, the electromagnetic relay 10 has the first terminals 66 extending out of the base 18. Specifically, the movable spring 56 has at its base end the first terminals 66 extending out of the base 18. With the fixed contacts 54 and the movable contacts 58 having the terminals 66 or 68, respectively, the pair of the contacts which open and close by means of the electromagnetic relay 10 may be connected to a load circuit 80 so as to be provided in parallel to each other. With the contact part 16 provided in parallel in this manner, an electric resistance at each contact becomes lower, and, as a result, heat generation will be limited. Thus, the durability of the contact part 16 and therefore the electromagnetic relay 10 can be improved.

It is preferable that the electromagnet part 12 includes the coil terminals 30 extending out of the base 18, that the contact part 16 includes the load terminals (the first terminal 66 or the second terminal 68, for example) connected to a load, and that the load terminals extend out of the base 18 longer than the coil terminals 30. With the configuration, efficiency in an operation of mounting these load terminals to a substrate (not shown) will be improved. In comparison with the fixed plates 52 or the movable springs 56, these terminals extending from their base ends have greater thickness, and therefore, strong soldering has to be applied when the terminals are mounted to the substrate (not shown). For this purpose, a higher temperature during a soldering process may be considered. As the terminals extend out longer, the area which can be heated becomes broader, and a heating process is facilitated.

The embodiment of the electromagnetic relay including two electromagnetic coils 26 corresponding to the number of sets of the contacts has been described. However, in the case where only one electromagnetic coil 16 is required for producing enough power, one electromagnetic coil 26 may be used for the two movable springs 56.

The invention claimed is:

1. An electromagnetic relay, comprising:

a plurality of electromagnet parts, each including an electromagnetic coil;

a plurality of actuating parts, each associated with a corresponding electromagnetic part and actuated in response to a magnetic action of the corresponding electromagnet part;

a single card, actuated based on actuation of the actuating parts, having a plurality of engaging portions, each associated with a corresponding actuating part and adapted to engage with the corresponding actuating part;

a base holding the electromagnetic parts and the card; and a plurality of contact parts, each of which includes a fixed plate having a first end fixed to the base and a second end opposite the first end, a fixed plate contact attached to the second end of the fixed plate, a movable spring having a first end fixed to the base and a second end opposite the first end, with a longitudinal axis between the first and second ends, and a movable spring contact attached to the second end of the movable spring, the longitudinal axis of the movable spring passing through the movable spring contact; and at least one connecting portion extending between and electrically connecting movable springs of two adjacent contact parts, wherein the card includes a single pressing portion adapted to press only a portion of each of the movable springs of the adjacent contact parts inside an area between the longitudinal axis of each of the movable springs of the adjacent contact parts.

2. The electromagnetic relay according to claim 1, wherein the at least one connecting portion is a conductive piece separately formed from and attached to the movable springs of the adjacent contact parts.

3. The electromagnetic relay according to claim 2, wherein the conductive piece has an asymmetric shape.

* * * * *